United States Patent [19]

Wilkerson et al.

[11] Patent Number: 4,989,691

[45] Date of Patent: Feb. 5, 1991

[54] INFLATABLE BOARDING LADDER AND RESCUE DEVICE

[76] Inventors: C. William Wilkerson, 902 Spar Ct., New Bern, N.C. 28560; James W. Gill, 3018 Buckingham Way, Apex, N.C. 27502

[21] Appl. No.: 519,746

[22] Filed: May 7, 1990

[51] Int. Cl.[5] ..... B63B 27/00

[52] U.S. Cl. ..... 182/70; 182/51; 182/97; 182/196; 114/362

[58] Field of Search ..... 182/194, 196, 48, 49, 182/51, 70, 93, 107; 114/362

[56] References Cited

U.S. PATENT DOCUMENTS

| | | | |
|---|---|---|---|
| 2,764,766 | 10/1956 | Boyle | 182/196 |
| 3,411,166 | 11/1968 | Kimmel | 182/196 |
| 4,723,929 | 2/1988 | Parish | 182/48 |

OTHER PUBLICATIONS

"Blow-Up Ladder", Popular Science, p. 94, Mar. 1965.

"Air Stair" Popular Mechanics, p. 85, May, 1966.

*Primary Examiner*—Reinaldo P. Machado

*Attorney, Agent, or Firm*—Rhodes, Coats & Bennett

[57] ABSTRACT

According to the preferred embodiment depicted, the inflatable boarding ladder comprises upper and lower ladder sections with stiffening rails and hand-holds interconnected by inflatable steps and the ladder back. The upper section is attached to the boat through a telescoping rod engaging and pivoting on mounting brackets. A pillow section provides hull standoff. The articulating lower ladder section pivots about the lower end of the upper section. A ballast section submerges the tapered lower ladder end into the water to ease access and to stabilize the ladder. Inflation and deployment of the ladder is by a gas source such as a foot pump or carbon dioxide cartridge. A deflation orifice permits storage in a soft pack and deck mounted cannister.

17 Claims, 2 Drawing Sheets

Fig.1
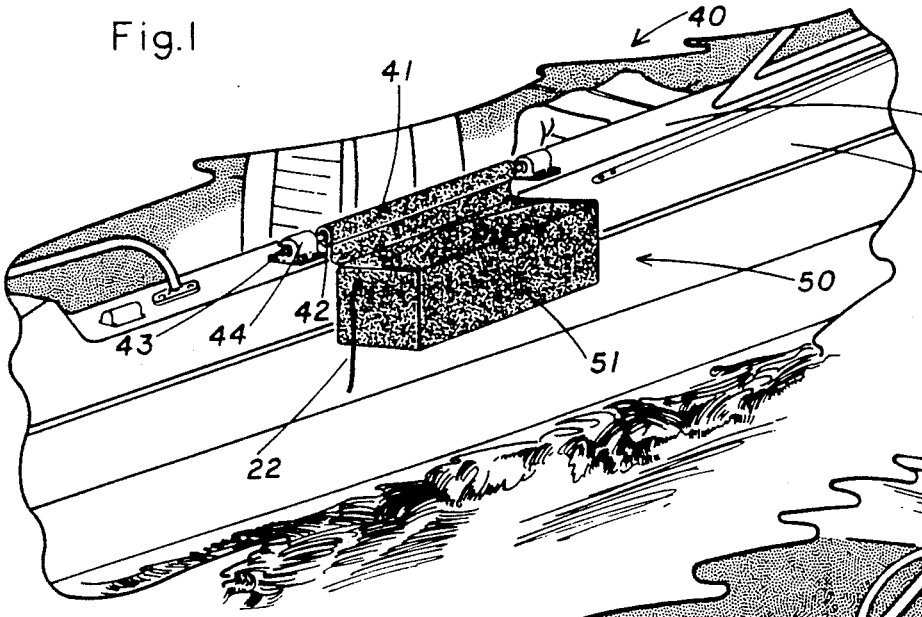
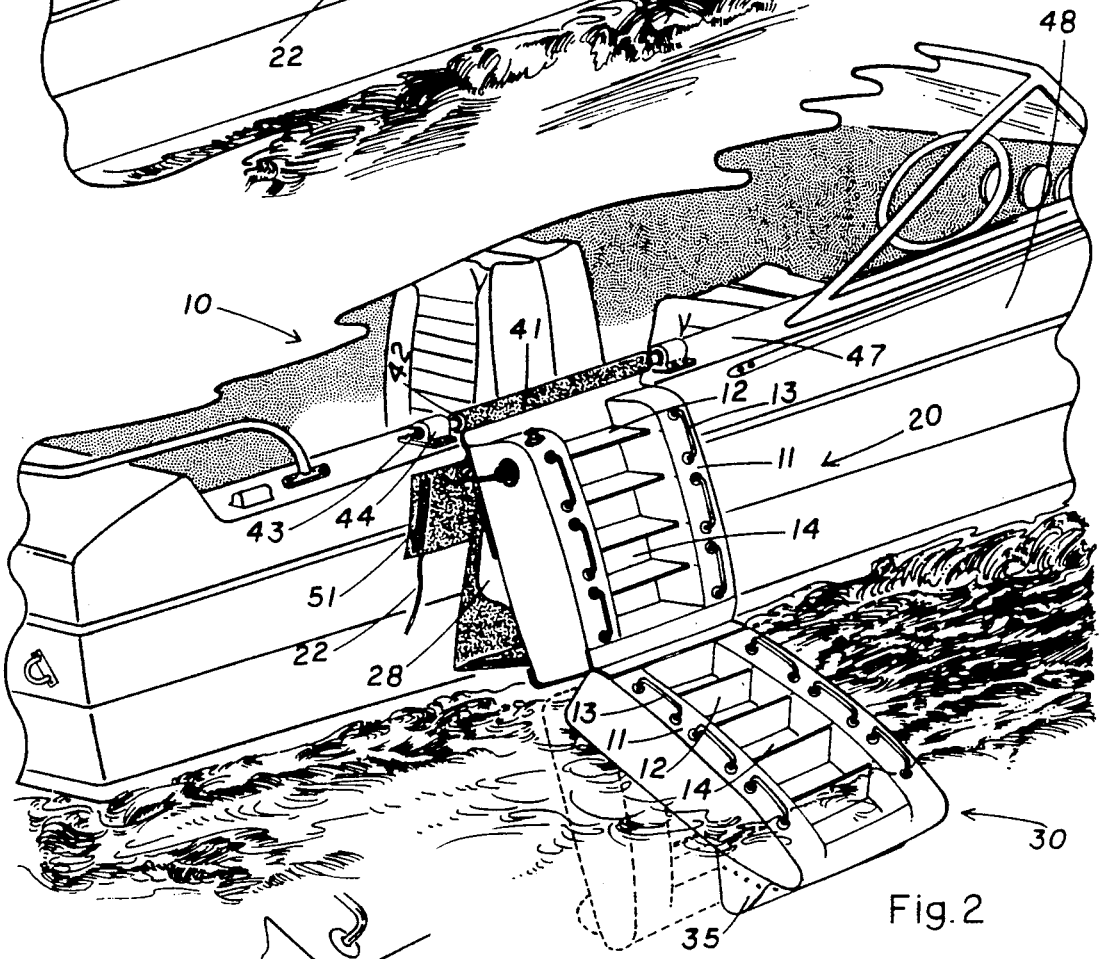
Fig.2
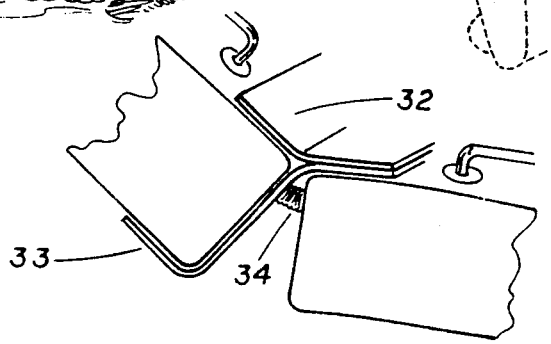
Fig.3

INFLATABLE BOARDING LADDER AND RESCUE DEVICE

FIELD OF THE INVENTION

The invention relates to inflatable ladders and inflatable rescue devices and more specifically to inflatable boarding ladders for swimmers to board boats from the water.

BACKGROUND OF THE INVENTION

Boarding a boat from a swimming position in the water can be a difficult task at best. Existing metal or wooden ladders often extend only a short distance below the water surface and have poor support for the feet. Boarding in rough seas can be near impossible and very hazardous for a person overboard. He may be struck by the rigid moving ladder or thrown from it.

Rescue devices such as lifting slings are time consuming and difficult to use. They still subject the victim to injury through the movements of the boat and swinging of the lifting tackle in rough seas. Existing stern ladders can be very difficult to unlatch from the water and can strike the victim in a self rescue operation.

Additionally, existing ladders are bulky and can present a storage problem. Generally, they cannot be mounted ready for use when the boat is underway. They must be retrieved from the storage area and mounted when a rescue is required. This expends valuable time and effort.

U.S. Pat. No. 3,411,166 describes an inflatable boarding ladder and paddle combination for boats. It illustrates shortcomings of prior art with inflatable boarding ladders. The ladder mounts at a single point, has no ballast and is free to be blown about by wind and sea. It does not have an articulating, partially submerged, lower section as the present invention and would be extremely difficult to use in rough seas.

SUMMARY AND OBJECTS OF THE INVENTION

It is an object of this invention to set forth novel boarding means which overcome the aforementioned problems and provide improved safety and convenience, thereby saving lives and reducing injuries.

It is particularly an object of this invention to provide an inflatable boarding means which is easy to stow, easy to mount, easy to deploy and which provides easy access to board the boat from the water.

A further object of the invention is to provide a ladder that adjusts and conforms to various and changing deck heights above the water.

A further object of the invention is to provide ladder stabilizing by a partially submerged platform in an articulating lower section onto which a victim may swim for support and ease of access.

A further object of the invention is to provide a boat boarding means which can be deployed with minimum effort.

Further objects of this invention, as well as novel features thereof, will become apparent by reference to the following description and drawings which are merely illustrative of such invention.

BRIEF DESCRIPTION OF THE DRAWINGS

FIG. 1 is a perspective view showing the boarding ladder mounted on the side of a boat in its soft case and ready to deploy.

FIG. 2 is a perspective view showing the boarding ladder deployed and inflated.

FIG. 3 is and end view of the hinge configuration for the articulating joint between the lower and upper ladder sections.

DETAILED DESCRIPTION OF THE INVENTION

Figure 4:
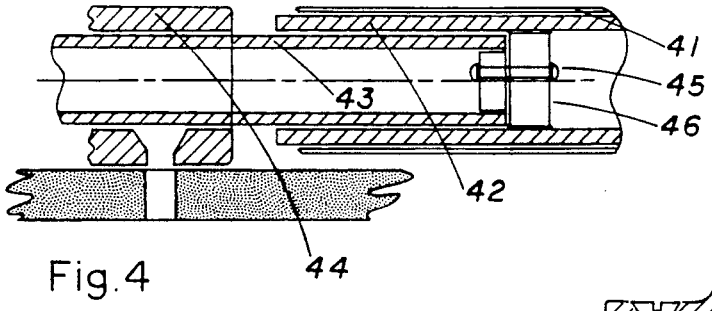
FIG. 4 is a cross sectional view of one end of the telescoping girt bar shown engaging the mounting brackets with a cam lock positioning the extended rod.

With further reference to the drawings, the overall ladder assembly is generally indicated by the numeral 10, the upper ladder section by numeral 20, the lower ladder section by numeral 30, the ladder attachment assembly by numeral 40 and the ladder enclosure by numeral 50.

Figure 5:
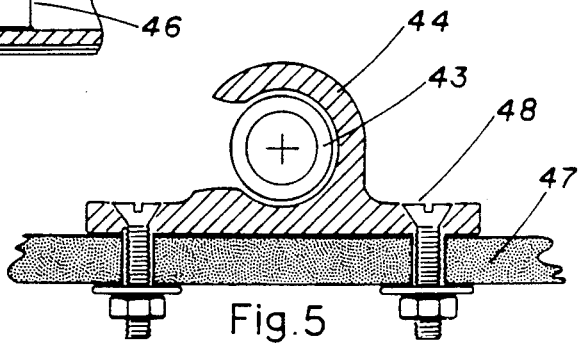
FIG. 5 is an end view of the mounting bracket with the telescoping girt bar engaged.
Figure 8:
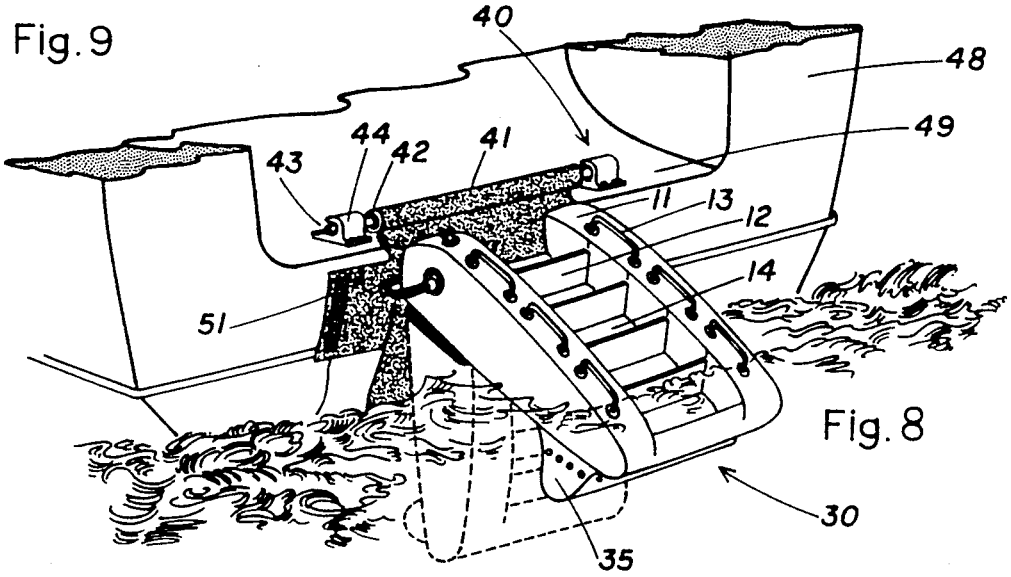
FIG. 8 is a perspective view of an alternate configuration of the present invention showing the lower articulating section of the ladder mounted directly to the boat.

Attachment to the deck 47 of the boat, as in FIGS. 1 and 2, is by brackets 44 engaging the telescoping ends 43 of a bar 42 passing through a girt sleeve 41 in the upper end of the ladder 20. This arrangement permits the upper ladder 20 to pivot about the edge of the deck. The upper ladder 20 is deployed on the side 48 of the boat. As shown in FIG. 4, the telescoping ends 43 are locked in position in the tubular bar 42 by turning the ends 43 to engage the cam 46 which has a surface with a high coefficient of friction. The cam 46 is essentially circular but rotates on an off centered pin 45 to cause the camming. As shown in FIG. 5, the brackets 44 are typically attached to the deck 47 by bolts, nuts and washers 48. The mounting provisions for the low freeboard alternative shown in FIG. 8 is identical to the above except that the mounting girt sleeve 41 attaches directly to the lower ladder section 30, the brackets 44 attach to the swimming shelf or through cockpit deck 49 and the ladder 30 is deployed off the boat transom or low free board side 48.

Figure 7:
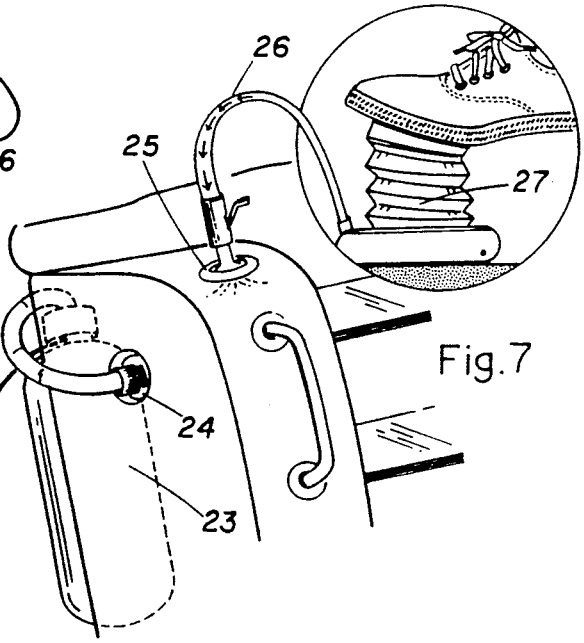
FIG. 7 illustrates a foot operated pump that can be utilized to inflate the present invention.

The ladder in the ready to deploy condition is stowed in a soft pack 51 which has edge closures such as velcro or snaps that open automatically on inflation of the ladder Sections 20 and 30 or alternatively can be readily opened by hand without tools. As shown in FIG. 7, a lanyard 22 leads from an inflation chamber containing a pressurized gas charge such as a carbon dioxide cartridge 23. Pulling the lanyard 22 activates a triggering mechanism 24 to pierce the gas cartridge and initiate inflation. Inflation can also be accomplished by a suitable air source such as a foot bellows 27, connected to the ladder through a hose 26 with standard connectors. An inlet valve 25 prevents back flow of pressurized gas. The air chambers and passages of the entire ladder are interconnected so that it may be inflated from one source. Inflation deploys the ladder 10 into position so that a swimmer may board the boat.

Figure 9:
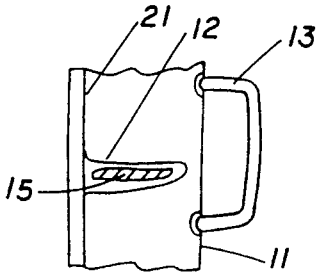
FIG. 9 is a sectional view showing a partially rigid insert inside a hollow step.

As shown in FIG. 2, the inflated ladder has an upper section 20 and lower section 30 with stiffening rails 11 on each side interconnected by inflatable step means 12 and ladder backs 14. The step means may contain rigidizing inserts 15, as shown in FIG. 9, so that they may be soft, semi-rigid or rigid. They could also comprise pockets or foot holds formed into the ladder backs, 14. Handhold means such as hand grips 13 are attached to each rail 11 to provide security when climbing the ladder. A pillow section 28 provides standoff from the side of the boat 48.

The articulating lower ladder section 30 pivots about the lower end of the upper ladder section 20 through the hinges 32 and 33 shown in FIG. 3. The hinges 32 and 33 are bonded and/or sewn to the upper and lower ladder sections 20 and 30. FIG. 3 also indicates the hose 34 which interconnects air passages between ladder sections. The entire inflatable ladder 10 is free to pivot about the edge of the deck 47.

Figure 6:
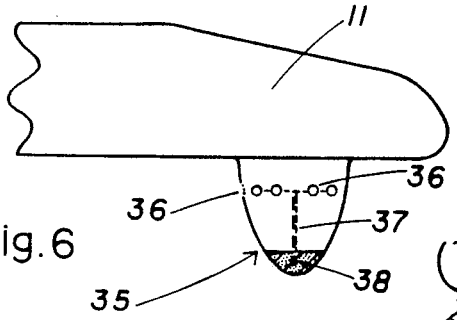
FIG. 6 is a sectional side view of the ballast chamber forming a part of the lower ladder section.

A Ballast section 35 is attached to the lower ladder section 30. As shown in FIG. 6, the ballast section 35 has baffles 37, sea water openings 36 in the walls and baffles, and may use a weight 38. The ballast section 35 permits sea water to enter when submerged. It releases water slowly when removed from the water but can be emptied completely when the lower ladder section 30 is folded back into an inverted vertical position. In addition to being ballasted, the lower ladder section 30 has tapered side rails 11. These provisions adjust the buoyancy to submerge the lower end of lower ladder section 30 in the water providing easy access for a swimmer to maneuver onto the ladder 10. As the swimmer applies his weight, the lower end of ladder section 30 sinks and assumes an attitude more toward vertical as indicated by the dash lines FIGS. 2 and 8. The steps may then be easily climbed to get aboard. The submergence of the lower end of lower ladder section 30 also stabilizes the entire ladder 10 so that it is not easily thrown about by wind and sea.

To stow the ladder 10, it is deflated by opening the deflation orifice(s) at valve 25 and squeezing the air chambers to expel the air. If a vacuum source is available, this may be attached through standard connectors and used to purge the air rapidly. If the carbon dioxide cartridge 23 has been expended, it may be replaced in the inflation chamber. The deflated ladder 10 is folded up and the soft pack 51 is closed. The ladder is then in the ready-to-deploy configuration, as shown in FIG. 1. It may be left mounted if it is at a location that does not interfere with other boat functions. Otherwise, the telescoping ends 43 of bar 42 may be retracted and disengaged from the mounting brackets 44. The ladder 10 in its soft pack 51 may then be stowed in a compartment or alternatively in a hard case attached to the exterior of the boat.

While we have described our invention in connection with a specific embodiment thereof, it is clearly understood that this is done only by way of example and not as a limitation to the scope of our invention as set forth in the objects thereof and in the claims.

We claim:

1. An inflatable boarding ladder for a boat adapted to extend from the boat downwardly into the surrounding water comprising:

(a) an inflatable upper ladder section adapted to be secured to the boat and, when deployed, extending downwardly from an exterior portion of the boat;

(b) an inflatable lower ladder section secured to a lower portion of the upper ladder section and dependent therefrom;

(c) means for moveably securing the lower ladder section to the upper ladder section such that the lower ladder section may pivot about the upper section; and (d) means associated with the lower ladder section for at least partially submerging the same in the surrounding water while the lower ladder section is dependent from the upper ladder section.

2. The inflatable ladder of claim 1 wherein the same includes an enclosure for holding the ladder when the same is in a non-deployed uninflated mode.

3. The inflatable ladder of claim 1 including inflation means associated with the inflatable ladder.

4. The inflatable ladder of claim 3 wherein the inflation means comprises a gas container associated with the ladder and wherein the gas container is provided with means for actuating the same such that upon actuation the gas container is opened to deploy a gas throughout the inner portion of the ladder for the purpose of inflating the same.

5. The inflatable ladder of claim 3 wherein the inflation means includes an inflation valve formed in the wall of the ladder and adapted to connect to an air source.

6. The inflatable ladder of claim 1 including a ladder mounting mechanism associated with the upper ladder section for securing the inflatable ladder to the boat above the water.

7. The inflatable ladder of claim 6 wherein the ladder mounting mechanism includes means for pivotly mounting the upper ladder section to the boat.

8. The inflatable ladder of claim 7 wherein the means for pivotly mounting the upper ladder section includes an elongated bar secured to the boat and a girt sleeve associated with the upper ladder section and extending around the bar so as to secure the upper ladder section to the boat.

9. The inflatable ladder of claim 8 wherein the elongated bar includes telescoping ends that having a locking means associated therewith to maintain the telescoping ends in an extended or retracted mode.

10. The inflatable ladder of claim 9 wherein the locking means is a cam lock.

11. The inflatable ladder of claim 1 wherein both the upper and lower ladder sections include a pair of laterally spaced side rails interconnected by a series of spaced steps and wherein the side rails and steps are hollow so as to give rise to an inflatable ladder construction.

12. The inflatable ladder of claim 11 wherein the steps include at least partially rigid inserts for reducing deflection of the steps under load.

13. The inflatable ladder of claim 11 wherein the side rails include handhold means to assist a swimmer in boarding the boat.

14. The inflatable ladder of claim 13 wherein the handhold means are handles attached to the side rails.

15. The inflatable ladder of claim 1 wherein the means for partially submerging the lower ladder section includes a ballast section secured to the lower ladder section.

16. The inflatable ladder of claim 15 wherein the ballast section is weighted and has holes permitting water entry and baffles to slow release of water.

17. An inflatable ladder for use in boarding a boat comprising:

(a) a main inflatable ladder section having inflatable side rails and step means incorporated;

(b) means associated with the main ladder section for moveably mounting the inflatable ladder to the boat permitting movement between a generally horizontal non-loaded position and a second generally vertical loaded position; and (c) means associated with the main ladder section for at least partially submerging the lower portion thereof when the same assumes the non-loaded position.

* * * * *